US010119182B2

(12) United States Patent
Osaki et al.

(10) Patent No.: US 10,119,182 B2
(45) Date of Patent: Nov. 6, 2018

(54) NI-BASED SUPERALLOY FOR HOT FORGING

(71) Applicant: DAIDO STEEL CO., LTD., Nagoya-shi (JP)

(72) Inventors: Mototsugu Osaki, Nagoya (JP); Shigeki Ueta, Nagoya (JP); Kohki Izumi, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 0 days.

(21) Appl. No.: 15/405,204

(22) Filed: Jan. 12, 2017

(65) Prior Publication Data

US 2017/0240997 A1 Aug. 24, 2017

(30) Foreign Application Priority Data

Feb. 18, 2016 (JP) ..... 2016-029375

(51) Int. Cl.
*C22C 19/05* (2006.01)

(52) U.S. Cl.
CPC ..... *C22C 19/056* (2013.01)

(58) Field of Classification Search
CPC ..... C22C 19/056
See application file for complete search history.

(56) References Cited

U.S. PATENT DOCUMENTS 5,476,555 A * 12/1995 Erickson ..... C22C 19/056 148/410
9,738,953 B2 * 8/2017 Osaki ..... C22C 19/056
2006/0157171 A1 7/2006 Ueta et al.
2012/0183432 A1 7/2012 Devaux et al.
2013/0160466 A1 6/2013 Sato et al.
2014/0345752 A1 11/2014 Takahashi et al.
2014/0373979 A1 12/2014 Gu et al.
2015/0284823 A1 10/2015 Osaki et al.
2017/0081750 A1 3/2017 Gu et al.

FOREIGN PATENT DOCUMENTS

EP 2 612 937 A1 7/2013
EP 2 778 241 A1 9/2014
EP 2 806 047 A1 11/2014
EP 2 826 877 A2 1/2015
JP 2013-502511 A 1/2013
JP 2015-129341 A 7/2015

OTHER PUBLICATIONS

ASM International, Materials Park, Ohio, Properties and Selection: Nonferrous Alloys and Special Purpose Materials: "Rare Earth Metals", Oct. 1990, vol. 2, pp. 720-732.*
Extended European Search Report in European Application No. 17154800.1 dated Jun. 6, 2017.

* cited by examiner

*Primary Examiner* — Jessee R Roe
(74) *Attorney, Agent, or Firm* — McGinn IP Law Group, PLLC

(57) ABSTRACT

The present invention relates to an Ni-based superalloy for hot forging, containing, in terms of % by mass, C: more than 0.001% and less than 0.100%, Cr: 11% or more and less than 19%, Co: more than 5% and less than 25%, Fe: 0.1% or more and less than 4.0%, Mo: more than 2.0% and less than 5.0%, W: more than 1.0% and less than 5.0%, Nb: 2.0% or more and less than 4.0%, Al: more than 3.0% and less than 5.0%, and Ti: more than 1.0% and less than 3.0%, with the balance being unavoidable impurities and Ni, in which the component composition satisfies the following two relationships: $3.5 \leq ([Ti]+[Nb])/[Al] \times 10 < 6.5$ and $9.5 \leq [Al]+[Ti]+[Nb] < 13.0$.

13 Claims, No Drawings

NI-BASED SUPERALLOY FOR HOT FORGING

TECHNICAL FIELD

The present invention relates to an Ni-based superalloy for various products provided after hot-forging process. Particularly, it relates to a γ'-precipitation strengthened Ni-based superalloy for hot forging excellent in hot forgeability and also excellent in high-temperature strength.

BACKGROUND ART

A γ'-precipitation strengthened Ni-based superalloy is used as, for example, high temperature parts for a gas turbine or a steam turbine that requires mechanical strength under high temperature environment. It is said that the γ'-phase is composed of Ti, Al, Nb, and Ta and that a precipitation amount thereof can be increased by increasing a content of these constituent elements in the alloy and thereby mechanical strength of the alloy at high temperature can be enhanced.

On the other hand, in the case where the precipitation amount of the γ'-phase is made large so as to increase the mechanical strength of the alloy at high temperature, the hot forgeability (hot workability) of the alloy in the production process decreases and, if deformation resistance is thereby made excessively large, the forging itself cannot be performed in some cases. Particularly, it becomes a large problem in a large-sized product such as a turbine disk in which deformation by hot forging is unavoidable. Accordingly, a component composition of an Ni-based superalloy having both of the high-temperature strength and the hot forgeability has been investigated.

For example, Patent Document 1 discloses, as such an Ni-based superalloy, an alloy containing, in terms of % by mass, Al of from 1.3 to 2.8%, Co of from a minute amount to 11%, Cr of from 14 to 17%, Fe of from a minute amount to 12%, Mo of from 2 to 5%, Nb+Ta of from 0.5 to 2.5%, Ti of from 2.5 to 4.5%, W of from 1 to 4%, B of from 0.0030 to 0.030%, C of from a minute amount to 0.1%, and Zr of from 0.01 to 0.06%, in which, in terms of atomic %, (1) Al+Ti+Nb+Ta is from 8 to 11 and (2) (Ti+Nb+Ta)/Al is from 0.7 to 1.3. Therein, it is said that the total amount of Al, Ti, Nb, and Ta defines the solid solution temperature of the γ' phase and the γ' phase fraction, and according to the expression (1), the γ' phase fraction is controlled within a range of from 30 to 44% and the solid solution temperature is controlled to lower than 1145° C. Furthermore, it is said that, according to the expression (2), the mechanical strength under high temperature environment owing to the γ' phase is enhanced and also the precipitation of harmful n-type and δ-type needle-like intermetallic compound phases is prevented. It is said that according to the above, the alloy has such a high forgeability that cracking is not generated even in the forging at a temperature higher than the solid solution temperature of the γ' phase, which is impossible in the case of UDIMET 720 ("UDIMET" is a registered trademark), and also said that the mechanical strength at 700° C. that is an operating temperature of a turbine can be increased as compared with the case of the Ni-based superalloy called 718 Plus.

Moreover, Patent Document 2 discloses an Ni-based superalloy having a component composition containing, in terms of % by mass, C of more than 0.001% and less than 0.100%, Cr of 11.0% or more and less than 19.0%, Co of 0.5% or more and less than 22.0%, Fe of 0.5% or more and less than 10.0%, Si of less than 0.1%, Mo of more than 2.0% and less than 5.0%, W of more than 1.0% and less than 5.0%, Mo+½W of 2.5% or more and less than 5.5%, S of less than 0.010%, Nb of 0.3% or more and less than 2.0%, Al of more than 3.00% and less than 6.50%, Ti of 0.20% or more and less than 2.49%, in which, in terms of atomic %, Ti/Al×10 is 0.2 or more and less than 4.0 and Al+Ti+Nb is 8.5% or more and less than 13.0%. Particularly, in Patent Document 2, the precipitation amount of the γ' phase is increased by increasing the addition amount of Al, Ti, and Nb and, it is described that the high-temperature strength and the hot forgeability are in a trade-off relationship. In Patent Document 2, it is said that the content of Al is increased to prevent the solid solution temperature of the γ' phase from rising and the high-temperature strength and the hot forgeability are both achieved. Therein, the content of Nb is controlled within a range of 0.3% or more and less than 2.0% and it is said that, in the case where Nb is contained in excess, the solid solution temperature of the γ' phase rises to lower the forging workability and a Laves phase that is an embrittlement' hase is generated to lower the high-temperature strength.

Patent Document 1: JP-T-2013-502511

Patent Document 2: JP-A-2015-129341

SUMMARY OF THE INVENTION

An Ni-based superalloy achieving both of the high-temperature strength and the hot forgeability is desired, and investigations have been made on a component composition thereof. As described above, in Patent Documents 1 and 2, it is tried to adjust the high-temperature mechanical strength by adjusting the content of Al, Ti, Nb, and Ta that are constituent elements of the γ' phase having large influence on mechanical strength to control the solid solution temperature and the precipitation amount of the γ' phase in the alloy.

The present invention is made in consideration of such circumstances, and an object thereof is to provide an Ni-based superalloy having both of the high-temperature strength which enables endurance in the use under high temperature environment, for example, in the case of a turbine system or the like, and good hot forgeability in the production process.

The Ni-based superalloy according to the present invention is an Ni-based superalloy for hot forging, having a component composition consisting of, in Willis of % by mass, C: more than 0.001% and less than 0.100%,
Cr: 11% or more and less than 19%,
Co: more than 5% and less than 25%,
Fe: 0.1% or more and less than 4.0%,
Mo: more than 2.0% and less than 5.0%,
W: more than 1.0% and less than 5.0%,
Nb: 2.0% or more and less than 4.0%,
Al: more than 3.0% and less than 5.0%, and
Ti: more than 1.0% and less than 3.0%, and
optionally,
B: less than 0.03%,
Zr: less than 0.1%,
Mg: less than 0.030%,
Ca: less than 0.030%, and
REM: 0.200% or less
with the balance being unavoidable impurities and Ni, in which, when a content of an element M in terms of atomic % is represented by [M], the component composition satisfies the following two relationships:

$3.5 \leq ([Ti]+[Nb])/[Al] \times 10 < 6.5$ and $9.5 \leq [Al]+[Ti]+[Nb] < 13.0$.

According to the present invention, the solid solution temperature of the γ' phase can be lowered while increasing the whole content of the constituent elements of the γ' phase, particularly the content of Nb. Therefore, an Ni-based superalloy having good hot forgeability can be attained while enhancing high-temperature strength in a temperature range where a turbine system or the like is used.

In the present invention, the component composition may contain, in terms of % by mass, at least one element selected from the group consisting of:

B: 0.0001% or more and less than 0.03% and

Zr: 0.0001% or more and less than 0.1%.

According to such an aspect of the present invention, the high-temperature strength which enables endurance in the use under high temperature environment can be further enhanced while maintaining the good hot forgeability in the production process.

In the present invention, the component composition may contain, in terms of % by mass, at least one element selected from the group consisting of:

Mg: 0.0001% or more and less than 0.030%,

Ca: 0.0001% or more and less than 0.030%, and

REM: 0.001% or more and 0.200% or less.

According to such an aspect of the present invention, the high-temperature strength which enables endurance in the use under high temperature environment can be enhanced and also the good hot forgeability in the production process can be further enhanced.

MODES FOR CARRYING OUT THE INVENTION

Table 1 shows component compositions of Ni-based superalloys as Examples of the present invention and Table 2 shows that as Comparative Examples. Moreover, Table 3 shows values of the expressions 1 and 2 showing relations of the constituent elements of the γ' phase and results of high-temperature tensile tests on the alloys after an aging treatment, of such Examples and Comparative Examples. The following will explain a method of preparing specimens and a method of the high-temperature tensile test.

TABLE 1

| | Component composition (% by mass) | | | | | | | | | | | | | | |
|---|---|---|---|---|---|---|---|---|---|---|---|---|---|---|---|
| | C | Ni | Fe | Co | Cr | W | Mo | Nb | Al | Ti | Zr | B | Mg | Ca | REM |
| Ex. 1 | 0.01 | 52.2 | 2.5 | 16.9 | 15.8 | 2.3 | 2.9 | 2.2 | 3.2 | 2.0 | — | — | — | — | — |
| Ex. 2 | 0.01 | 49.0 | 1.3 | 19.8 | 17.0 | 1.7 | 3.5 | 2.4 | 3.5 | 1.8 | — | — | — | — | — |
| Ex. 3 | 0.02 | 46.9 | 1.7 | 20.3 | 18.1 | 2.0 | 3.2 | 2.6 | 3.1 | 2.1 | — | — | — | — | — |
| Ex. 4 | 0.02 | 56.5 | 3.3 | 14.5 | 13.3 | 1.2 | 4.0 | 2.3 | 3.2 | 1.7 | — | — | — | — | — |
| Ex. 5 | 0.02 | 53.5 | 2.2 | 13.7 | 17.5 | 2.6 | 2.7 | 3.0 | 3.4 | 1.4 | — | — | — | — | — |
| Ex. 6 | 0.03 | 55.6 | 1.0 | 15.0 | 14.7 | 1.9 | 3.8 | 2.8 | 3.1 | 2.1 | — | — | — | — | — |
| Ex. 7 | 0.04 | 53.1 | 1.6 | 15.2 | 16.9 | 1.8 | 3.7 | 2.8 | 3.3 | 1.6 | — | — | — | — | — |
| Ex. 8 | 0.02 | 49.0 | 2.9 | 18.1 | 17.2 | 2.4 | 2.8 | 2.3 | 3.9 | 1.4 | — | — | — | — | — |
| Ex. 9 | 0.01 | 50.8 | 1.8 | 17.9 | 17.1 | 2.2 | 3.0 | 2.5 | 3.3 | 1.4 | — | — | — | — | — |
| Ex. 10 | 0.03 | 51.6 | 2.1 | 16.6 | 16.6 | 2.5 | 2.9 | 2.6 | 3.6 | 1.5 | — | — | — | — | — |
| Ex. 11 | 0.05 | 51.1 | 2.4 | 16.4 | 16.7 | 3.1 | 2.7 | 3.2 | 3.2 | 1.1 | 0.020 | 0.014 | — | — | — |
| Ex. 12 | 0.04 | 48.0 | 1.2 | 21.0 | 15.9 | 3.3 | 2.7 | 2.5 | 4.0 | 1.3 | 0.030 | — | — | — | — |
| Ex. 13 | 0.06 | 51.4 | 0.7 | 19.7 | 14.8 | 2.7 | 2.9 | 2.5 | 3.3 | 1.9 | — | 0.010 | — | — | — |
| Ex. 14 | 0.02 | 48.9 | 0.9 | 21.6 | 15.0 | 2.9 | 3.1 | 2.1 | 3.6 | 1.9 | — | — | — | — | — |
| Ex. 15 | 0.03 | 48.8 | 3.2 | 18.2 | 16.2 | 1.9 | 3.6 | 2.9 | 4.1 | 1.1 | — | 0.013 | — | — | — |
| Ex. 16 | 0.04 | 48.0 | 2.0 | 18.8 | 17.8 | 2.1 | 3.3 | 2.7 | 3.5 | 1.7 | 0.040 | — | — | — | — |
| Ex. 17 | 0.03 | 51.1 | 1.5 | 17.5 | 16.5 | 3.8 | 2.1 | 2.4 | 3.5 | 1.6 | — | — | — | — | — |
| Ex. 18 | 0.01 | 54.1 | 1.4 | 15.4 | 16.3 | 1.3 | 3.9 | 2.5 | 3.7 | 1.4 | — | — | — | — | — |
| Ex. 19 | 0.02 | 51.7 | 1.9 | 17.3 | 15.7 | 2.4 | 2.7 | 2.7 | 3.4 | 2.2 | — | — | — | — | 0.079 |
| Ex. 20 | 0.03 | 49.9 | 1.1 | 18.3 | 17.0 | 2.2 | 3.4 | 3.0 | 3.4 | 1.6 | 0.030 | 0.014 | — | 0.0012 | — |
| Ex. 21 | 0.02 | 51.7 | 1.2 | 17.9 | 15.8 | 2.8 | 2.6 | 2.9 | 3.3 | 1.7 | 0.040 | 0.013 | 0.001 | — | — |

TABLE 2

| | Component composition (% by mass) | | | | | | | | | | | | | | |
|---|---|---|---|---|---|---|---|---|---|---|---|---|---|---|---|
| | C | Ni | Fe | Co | Cr | W | Mo | Nb | Al | Ti | Zr | B | Mg | Ca | REM |
| Comp. Ex 1 | 0.03 | 61.5 | 2.5 | 9.0 | 16.0 | 2.5 | 3.2 | 0.5 | 4.0 | 0.8 | — | — | — | — | — |
| Comp. Ex 2 | 0.03 | 67.7 | 3.8 | 1.7 | 15.3 | 3.2 | 3.0 | 1.1 | 3.7 | 0.5 | — | — | — | — | — |
| Comp. Ex 3 | 0.01 | 58.1 | 4.3 | 9.8 | 16.0 | 2.5 | 3.0 | 1.6 | 4.3 | 0.4 | — | — | — | — | — |
| Comp. Ex 4 | 0.05 | 59.4 | 4.6 | 9.5 | 16.3 | 2.0 | 2.3 | 0.9 | 3.8 | 1.2 | — | — | — | — | — |
| Comp. Ex 5 | 0.04 | 68.3 | 4.2 | 1.3 | 16.5 | 1.8 | 2.2 | 1.5 | 3.4 | 0.8 | — | — | — | — | — |
| Comp. Ex 6 | 0.03 | 61.0 | 3.7 | 6.7 | 17.2 | 2.3 | 3.0 | 1.4 | 3.3 | 1.4 | — | — | — | — | — |
| Comp. Ex 7 | 0.05 | 59.4 | 4.1 | 9.2 | 15.8 | 2.4 | 3.0 | 1.1 | 4.1 | 0.8 | 0.025 | 0.014 | — | — | — |
| Comp. Ex 8 | 0.04 | 59.4 | 3.9 | 9.0 | 16.1 | 2.5 | 2.9 | 1.2 | 4.0 | 0.9 | — | 0.016 | — | — | — |
| Comp. Ex 9 | 0.06 | 59.7 | 3.9 | 8.9 | 15.9 | 2.5 | 3.1 | 1.1 | 3.9 | 0.9 | 0.032 | — | — | — | — |
| Comp. Ex 10 | 0.04 | 59.3 | 3.9 | 9.0 | 16.1 | 2.3 | 3.1 | 1.2 | 4.2 | 0.9 | — | — | — | 0.013 | — |
| Comp. Ex 11 | 0.05 | 60.1 | 3.9 | 8.8 | 15.8 | 2.5 | 3.0 | 1.1 | 4.0 | 0.8 | — | — | 0.010 | — | — |
| Comp. Ex 12 | 0.04 | 59.4 | 3.9 | 9.1 | 16.0 | 2.4 | 3.0 | 1.2 | 4.1 | 0.9 | — | — | — | — | 0.100 |
| Comp. Ex 13 | 0.02 | 58.6 | 4.0 | 8.8 | 16.1 | 2.6 | 2.8 | 1.1 | 2.3 | 3.6 | 0.031 | 0.015 | — | — | — |

TABLE 3

| | Value of Expression 1 | Value of Expression 2 | 0.2% Yield strength at 730° C. | Tensile strength at 730° C. |
|---|---|---|---|---|
| Ex. 1 | 10.5 | 5.5 | B | B |
| Ex. 2 | 11.0 | 4.9 | B | B |
| Ex. 3 | 10.6 | 6.3 | A | A |
| Ex. 4 | 10.2 | 5.1 | B | B |
| Ex. 5 | 10.7 | 4.9 | B | B |
| Ex. 6 | 10.8 | 6.4 | A | A |
| Ex. 7 | 10.6 | 5.2 | A | B |
| Ex. 8 | 11.2 | 3.7 | B | B |
| Ex. 9 | 10.2 | 4.6 | B | B |
| Ex. 10 | 11.0 | 4.4 | B | B |
| Ex. 11 | 10.1 | 4.8 | B | B |
| Ex, 12 | 11.5 | 3.6 | B | B |
| Ex. 13 | 10.8 | 5.4 | A | B |
| Ex. 14 | 11.2 | 4.7 | B | B |
| Ex. 15 | 11.7 | 3.6 | B | B |
| Ex. 16 | 11.0 | 5.0 | B | B |
| Ex. 17 | 10.8 | 4.6 | B | B |
| Ex. 18 | 11.0 | 4.1 | B | B |
| Ex. 19 | 11.5 | 6.0 | A | A |
| Ex. 20 | 10.9 | 5.2 | A | A |
| Ex. 21 | 10.8 | 5.5 | A | A |
| Comp. Ex. 1 | 9.6 | 1.5 | C | C |
| Comp. Ex. 2 | 9.1 | 1.6 | C | C |
| Comp. Ex. 3 | 10.4 | 1.6 | B | C |
| Comp. Ex. 4 | 9.8 | 2.5 | C | C |
| Comp. Ex. 5 | 9.0 | 2.6 | C | C |
| Comp. Ex. 6 | 9.5 | 3.6 | C | C |
| Comp. Ex. 7 | 10.2 | 1.9 | B | C |
| Comp. Ex. 8 | 10.1 | 2.1 | B | C |
| Comp. Ex. 9 | 9.9 | 2.1 | B | C |
| Comp. Ex. 10 | 10.5 | 2.0 | C | C |
| Comp. Ex. 11 | 10.0 | 1.9 | B | C |
| Comp. Ex. 12 | 10.3 | 2.1 | B | C |
| Comp. Ex. 13 | 9.9 | 10.2 | A | C |

First, each of the molten alloys having component compositions shown in Tables 1 and 2 was produced by using a high-frequency induction furnace to prepare a 50 kg of ingot. After the casted ingot was subjected to a homogenization thermal treatment at from 1,100° C. to 1,220° C. for 16 hours, round bar materials having a diameter of 30 mm were prepared by hot forging and was further subjected to a solid solution thermal treatment at 1,030° C. for 4 hours (air cooling) and to an aging treatment at 760° C. for 24 hours. Incidentally, in the hot forging, workability sufficient for forging was observed in all component compositions of Examples and Comparative Examples.

A specimen for the high-temperature tensile test was cut out from the round bar material after the aging treatment and high temperature tensile test was carried out where the specimen was isothermally held at 730° C. that is presumed as maximum operating temperature of the turbine system and then a load was imparted. As results of this test, 0.2% yield strength and tensile strength were measured and were shown in Table 3 with classifying individual results into ranks A to C. Here, the ranks for 0.2% yield strength are as follows:

A: 1,000 MPa or more,

B: 960 MPa or more and less than 1,000 MPa, and

C: less than 960 MPa.

The ranks for tensile strength are as follows:

A: 1,180 MPa or more,

B: 1,110 MPa or more and less than 1,180 MPa, and

C: less than 1,110 MPa.

In Table 3, as for the relationship among the contents of Al, Ti, and Nb, values of the following Expressions 1 and 2 in terms of atomic % were calculated and shown. The expressions 1 and 2 are as follows when the content of an element M in terms of atomic % is represented by [M]:

$$[Al]+[Ti]+[Nb], \qquad \text{Expression 1}$$

and $$([Ti]+[Nb])/[Al]\times 10. \qquad \text{Expression 2}$$

Here, Expression 1 represents a total content of the elements that form the γ' phase. Mainly, it is proportional to the tendency of increasing the precipitation amount of the γ' phase in a temperature range lower than the solid solution temperature of the γ' phase and it becomes one index for enhancing the high-temperature strength of a forged product to be obtained. Expression 2 mainly becomes one index of a level of the solid solution temperature of the γ' phase described above. That is, there is a tendency that the solid solution temperature of γ' phase is raised by an increase in the contents of Ti and Nb and is lowered by an increase in the content of Al. If the solid solution temperature is low, hot forging can be conducted at lower temperature, which results in that "hot forgeability is excellent".

As shown in Table 3, as for the component compositions of Examples 1 to 21, the 0.2% yield strength and tensile strength were all evaluated as rank "A" or "B". Among Examples 3, 6 and 19 to 21 in which the 0.2% yield strength and tensile strength were both evaluated as rank "A", the component compositions of Examples 3, 6, and 19 showed the values of the expression 2 being so large as 6.0 or more, that of Example 19 contained REM, and that of Examples 20 and 21 contained both of Zr and B and either of Mg and Ca, respectively.

On the other hand, as for the component compositions of Comparative Examples 1 to 13, the 0.2% yield strength of Comparative Example 13 alone was evaluated as rank "A", the 0.2% yield strength of Comparative Examples 3, 7 to 9, 11, and 12 was evaluated as rank "B", and the 0.2% yield strength of the other Comparative Examples and the tensile strength of all Comparative Examples were all evaluated as rank "C". That is, the component compositions of Comparative Examples 1 to 13 have poor the high-temperature strength as compared with that in Examples. Moreover, in Comparative Example 6, the component composition and the values of the expressions 1 and 2 were controlled to equal levels to those of Examples except that the content of Nb was small, but the high temperature strength was lower than that in Examples.

As above, in the component compositions of Examples 1 to 21, it is concluded that the high-temperature strength can be enhanced with maintaining good hot forgeability, as compared with those in Comparative Examples 1 to 13.

Here, as for the value of the expression 1, a lower limit is set for securing the high-temperature strength and an upper limit is set for securing the hot forgeability. Moreover, as for the value of the expression 2, an upper limit is set for securing the hot forgeability and a lower limit is set for securing the high-temperature strength. From the above-described test results of Examples and Comparative Examples and other test results, the value of the expression 1 for obtaining the hot forgeability and high-temperature strength required for the Ni-based superalloy was determined to be 9.5 or more and less than 13.0, and preferably 10.5 or more and 11.6 or less. Moreover, the value of the expression 2 was determined to be 3.5 or more and less than 6.5, and preferably 5.0 or more and less than 6.5.

Incidentally, the composition range of the alloy capable of affording high-temperature strength and hot forgeability almost equal to those of the Ni-based superalloys including Examples described above is determined as follows.

C combines with Cr, Nb, Ti, W, and the like to foini various carbides. Particularly, Nb-based and Ti-based carbides having a high solid solution temperature can suppress, by a pinning effect thereof, crystal grains from coarsening through growth of the crystal grains under high temperature environment. Therefore, these carbides mainly suppress a decrease in toughness, and thus contributes to an improvement in hot forgeability. Also, C precipitates Cr-based, Mo-based, W-based, and other carbides in a grain boundary to strengthen the grain boundary and thereby contributes to an improvement in mechanical strength. On the other hand, in the case where C is added excessively, the carbides are excessively formed and an alloy structure is made uneven due to segregation or the like. Also, excessive precipitation of the carbides in the grain boundary leads to a decrease in the hot forgeability and mechanical workability. In consideration of these facts, C is contained, in terms of % by mass, within the range of more than 0.001% and less than 0.100%, and preferably within the range of more than 0.001% and less than 0.06%.

Cr is an indispensable element for densely forming a protective oxide film of $Cr_2O_3$ and Cr improves corrosion resistance and oxidation resistance of the alloy to enhance productivity and also makes it possible to use the alloy for long period of time. Also, Cr combines with C to form a carbide and thereby contributes to an improvement in mechanical strength. On the other hand, Cr is a ferrite stabilizing element, and its excessive addition makes austenite unstable to thereby promote generation of a a phase or a Laves phase, which are embrittlement phases, and cause a decrease in the hot forgeability, mechanical strength, and toughness. In consideration of these facts, Cr is contained, in terms of % by mass, within the range of 11% or more and less than 19%, and preferably within the range of 13% or more and less than 19%.

Co improves the hot forgeability by forming a solid solution in an austenite base that is the matrix of the Ni-based superalloy and also improves the high-temperature strength. On the other hand, Co is expensive and therefore its excessive addition is disadvantageous in view of cost. In consideration of these facts, Co is contained, in terms of % by mass, within the range of more than 5% and less than 25%, preferably within the range of more than 11% and less than 25%, and further preferably within the range of more than 15% and less than 25%.

Fe is an element unavoidably mixed in the alloy depending on the selection of raw materials at the alloy production, and the raw material cost can be suppressed when raw materials having a large Fe content are selected. On the other hand, an excessive content thereof leads to a decrease in the mechanical strength. In consideration of these facts, Fe is contained, in terms of % by mass, within the range of 0.1% or more and less than 4.0%, and preferably within the range of 0.1% or more and less than 3.0%.

Mo and W are solid solution strengthening elements that form a solid solution in the austenite phase having an FCC structure that is the matrix of the Ni-based superalloy, and distort the crystal lattice to increase the lattice constant. Also, both Mo and W combine with C to form carbides and strengthen the grain boundary, thereby contributing to an improvement in the mechanical strength. On the other hand, their excessive addition promotes generation of a a phase and a μ phase to lower toughness. In consideration of these facts, Mo is contained, in terms of % by mass, within the range of more than 2.0% and less than 5.0%. Also, W is contained, in terms of % by mass, within the range of more than 1.0% and less than 5.0%.

Nb combines with C to form an MC-type carbide having a relatively high solid solution temperature and thereby suppresses coarsening of crystal grains after solid-solution heat treatment (pining effect), thus contributing to an improvement in the high-temperature strength and hot forgeability. Also, Nb is large in atomic radius as compared with Al, and is substituted on the Al site of γ' phase ($Ni_3Al$) that is a strengthening phase to form $Ni_3(Al, Nb)$, thus distorting the crystal structure and improving the high-temperature strength. On the other hand, its excessive addition precipitates $Ni_3Nb$ having a BCT structure, a so-called γ" phase, through an aging treatment to improve the mechanical strength in a low-temperature region but, since the precipitated γ" phase transforms into a 8 phase at high temperature of 700° C. or higher, the mechanical strength is lowered. That is, Nb should have a content where the γ" phase is not generated. In consideration of these facts, Nb is contained, in terms of % by mass, within the range of 2.0% or more and less than 4.0%, preferably within the range of more than 2.1% and less than 4.0%, further preferably within the range of more than 2.1% and less than 3.5%, still further preferably within the range of more than 2.4% and less than 3.2%, and most preferably within the range of more than 2.6% and less than 3.2%.

Ti combines with C to form an MC-type carbide having a relatively high solid solution temperature and thereby suppresses coarsening of crystal grains after solid-solution heat treatment (pining effect) similar to Nb, thus contributing to an improvement in the high-temperature strength and hot forgeability. Also, Ti is large in atomic radius as compared with Al, and is substituted on the Al site of the γ' phase ($Ni_3Al$) that is a strengthening phase to form $Ni_3(Al, Ti)$, thus distorting the crystal structure and increasing the lattice constant to improve the high-temperature strength by forming a solid solution in the FCC structure. On the other hand, its excessive addition causes an increase in the solid solution temperature of the γ' phase and facilitates generation of the γ' phase in a primary crystal like a cast alloy, resulting in generation of an eutectic alloy γ' phase to lower the mechanical strength. In consideration of these facts, Ti is contained, in terms of % by mass, within the range of more than 1.0% and less than 3.0%.

Al is a particularly important element for producing the γ' phase ($Ni_3Al$) that is a strengthening phase to enhance the high-temperature strength, and lowers the solid solution temperature of the γ' phase to improve the hot forgeability. Furthermore, Al combines with O to form a protective oxide film of $Al_2O_3$ and thus improves corrosion resistance and oxidation resistance. Moreover, since Al predominantly produces the γ' phase to consume Nb, the generation of the γ" phase by Nb as described above can be suppressed. On the other hand, its excessive addition raises the solid solution temperature of the γ' phase and excessively precipitates the γ' phase, so that the hot forgeability is lowered. In consideration of these facts, Al is contained, in terms of % by mass, within the range of more than 3.0% and less than 5.0%.

B and Zr segregate at a grain boundary to strengthen the grain boundary, thus contributing to an improvement in the workability and mechanical properties. On the other hand, their excessive addition impairs ductility due to excessive segregation at the grain boundary. In consideration of these facts, B may be contained, in terms of % by mass, within the range of 0.0001% or more and less than 0.03%. Zr may be contained, in tennis of % by mass, within the range of 0.0001% or more and less than 0.1%. Incidentally, B and Zr are not essential elements and one or two thereof can be selectively added as arbitrary element(s).

Mg, Ca, and REM (rare earth metal) contribute to an improvement in the hot forgeability of the alloy. Moreover, Mg and Ca can act as a deoxidizing or desulfurizing agent during alloy melting and REM contributes to an improvement in oxidation resistance. On the other hand, their excessive addition rather lowers the hot forgeability due to their concentration at a grain boundary or the like. In consideration of these facts, Mg may be contained, in terms of % by mass, within the range of 0.0001% or more and less than 0.030%. Ca may be contained, in terms of % by mass, within the range of 0.0001% or more and less than 0.030%. REM may be contained, in terms of % by mass, within the range of 0.001% or more and 0.200% or less. Incidentally, Mg, Ca, and REM are not essential elements and one or two or more thereof can be selectively added as arbitrary element(s).

While typical Examples according to the present invention has been described in the above, the present invention is not necessarily limited thereto. One skilled in the art will be able to find various alternative Examples and changed examples without departing from the attached Claims.

The present application is based on Japanese Patent Application No. 2016-029375 filed on Feb. 18, 2016, which contents are incorporated herein by reference.

What is claimed is:

1. An Ni-based superalloy for hot forging, having a component composition consisting of, in terms of % by mass, C: more than 0.001% and less than 0.100%,
Cr: 11% or more and less than 19%,
Co: more than 5% and less than 25%,
Fe: 0.1% or more and less than 4.0%,
Mo: more than 2.0% and less than 5.0%,
W: more than 1.0% and less than 5.0%,
Nb: more than 2.6% and less than 3.2%,
Al: more than 3.0% and less than 5.0%, and
Ti: more than 1.0% and less than 3.0%,
with the balance being unavoidable impurities and Ni,
wherein, when a content of an element M in terms of atomic % is represented by [M], the component composition satisfies the following two relationships:

$$5.0 \leq ([Ti]+[Nb])/[Al] \times 10 < 6.5 \text{ and}$$

$$10.1 \leq [Al]+[Ti]+[Nb] \leq 11.6.$$

2. The Ni-based superalloy according to claim 1, wherein the component composition satisfies the following relationship:

$$10.5 \leq [Al]+[Ti]+[Nb] < 11.6.$$

3. The Ni-based superalloy according to claim 1, wherein the amount of C in the component composition in terms of % by mass is:

C: more than 0.001% and less than 0.06%.

4. The Ni-based superalloy according to claim 1, wherein the amount of Cr in the component composition in terms of % by mass is:

Cr: 13% or more and less than 19%.

5. The Ni-based superalloy according to claim 1, wherein the amount of Co in the component composition in terms of % by mass is:

Co: more than 15% and less than 25%.

6. The Ni-based superalloy according to claim 1, wherein the amount of Fe in the component composition in terms of % by mass is:

Fe: 0.1% or more and less than 3.0%.

7. A high temperature part for a gas turbine or steam turbine, comprising:

the Ni-based superalloy according to claim 1.

8. An Ni-based superalloy for hot forging, having a component composition consisting of, in terms of % by mass, C: more than 0.001% and less than 0.100%,
Cr: 11% or more and less than 19%,
Co: more than 5% and less than 25%,
Fe: 0.1% or more and less than 4.0%,
Mo: more than 2.0% and less than 5.0%,
W: more than 1.0% and less than 5.0%,
Nb: more than 2.6% and less than 3.2%,
Al: more than 3.0% and less than 5.0%,
Ti: more than 1.0% and less than 3.0%, and
at least one selected from the group consisting of
B: less than 0.03%,
Zr: less than 0.1%,
Mg: less than 0.030%,
Ca: less than 0.030%, and
REM: 0.200% or less,
with the balance being unavoidable impurities and Ni,
wherein, when a content of an element M in terms of atomic % is represented by [M], the component composition satisfies the following two relationships:

$$5.0 \leq ([Ti]+[Nb])/[Al] \times 10 < 6.5 \text{ and}$$

$$10.1 < [Al]+[Ti]+[Nb] \leq 11.6.$$

9. The Ni-based superalloy according to claim 8, wherein the component composition comprises, in terms of % by mass, at least one element selected from the group consisting of:

Mg: 0.0001% or more and less than 0.030%,
Ca: 0.0001% or more and less than 0.030%, and
REM: 0.001% or more and 0.200% or less.

10. The Ni-based superalloy according to claim 8, wherein the component composition comprises, in terms of % by mass, at least one element selected from the group consisting of:

B: 0.0001% or more and less than 0.03% and
Zr: 0.0001% or more and less than 0.1%.

11. The Ni-based superalloy according to claim 10, wherein the component composition comprises, in terms of % by mass, at least one element selected from the group consisting of:

Mg: 0.0001% or more and less than 0.030%,
Ca: 0.0001% or more and less than 0.030%, and
REM: 0.001% or more and 0.200% or less.

12. A high temperature part for a gas turbine or steam turbine, comprising:

the Ni-based superalloy according to claim 8.

13. An Ni-based superalloy for hot forging, having a component composition consisting of, in terms of % by mass, C: more than 0.001% and less than 0.06%,
Cr: 13% or more and less than 19%,
Co: more than 15% and less than 25%,
Fe: 0.1% or more and less than 3.0%,
Mo: more than 2.0% and less than 5.0%,
W: more than 1.0% and less than 5.0%,
Nb: more than 2.6% and less than 3.2%,
Al: more than 3.0% and less than 5.0%, and Ti: more than 1.0% and less than 3.0%, with the balance being unavoidable impurities and Ni, wherein, when a content of an element M in terms of atomic % is represented by [M], the component composition satisfies the following two relationships:

$$5.0 \leq ([Ti]+[Nb])/[Al] \times 10 < 6.5, \text{ and}$$

$$10.1 \leq [Al]+[Ti]+[Nb] \leq 11.6.$$

* * * * *